United States Patent [19]

Marshall

[11] 4,345,753

[45] Aug. 24, 1982

[54] PROCESS AND APPARATUS FOR ALIGNING PAPER DOCUMENTS

[75] Inventor: Robert Marshall, El Paso, Tex.

[73] Assignee: A. C. Nielsen Company, Northbrook, Ill.

[21] Appl. No.: 150,567

[22] Filed: May 16, 1980

[51] Int. Cl.[3] ..... B65H 3/62

[52] U.S. Cl. ..... 271/146; 271/210; 271/221

[58] Field of Search ..... 271/210, 221, 222, 146

[56] References Cited

U.S. PATENT DOCUMENTS

| | | | |
|---|---|---|---|
| 1,236,892 | 8/1917 | Wilson | 271/210 |
| 2,494,075 | 1/1950 | Weyandt | 271/210 |
| 3,223,410 | 12/1965 | Wilson | 271/210 |
| 3,862,752 | 1/1975 | Totten | 271/210 |

OTHER PUBLICATIONS

IBM Technical Disclosure Bulletin, vol. 19, No. 2, pp. 664, 665, Jul. 1976, Currency Cartridge, J. J. Lynott.

*Primary Examiner*—Richard A. Schacher
*Attorney, Agent, or Firm*—Mason, Kolehmainen, Rathburn & Wyss

[57] ABSTRACT

A process and apparatus for aligning paper documents includes a paper jogger having a removable paper tray for receiving a large number of individual paper documents, such as retail store coupons, and adapted to slide onto and to be removably secured to an oscillating platform of the paper jogger for aligning the edges of the paper documents. A removable divider is positioned in the tray to segregate the paper documents in the tray into discrete portions. The tray containing the divider and segregated paper documents is then placed on and secured to the platform for oscillation and resultant paper alignment. After the paper documents are sufficiently aligned, the tray may be removed from the platform for use in storing the aligned paper documents or in conveying the aligned paper documents to subsequent processing stations.

11 Claims, 7 Drawing Figures

Fig. 7
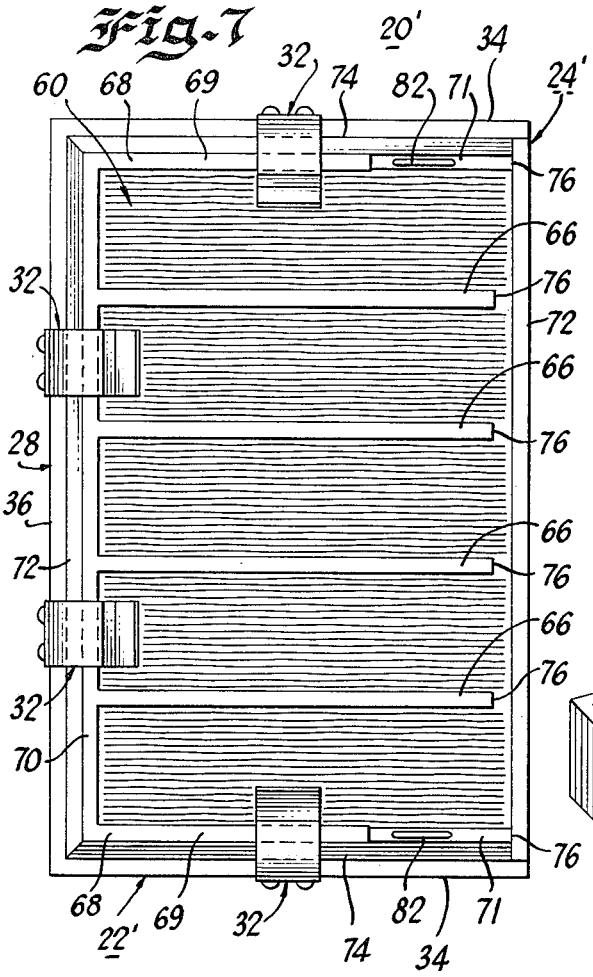
Fig. 5
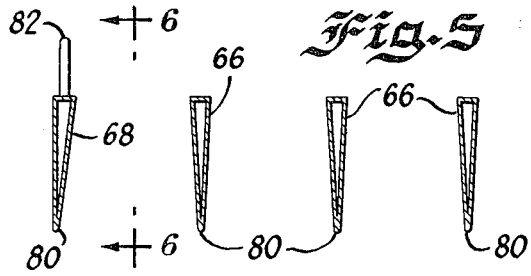
Fig. 6
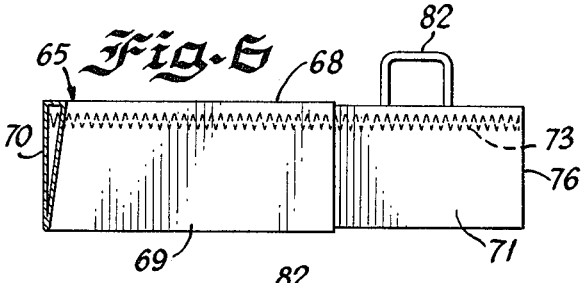
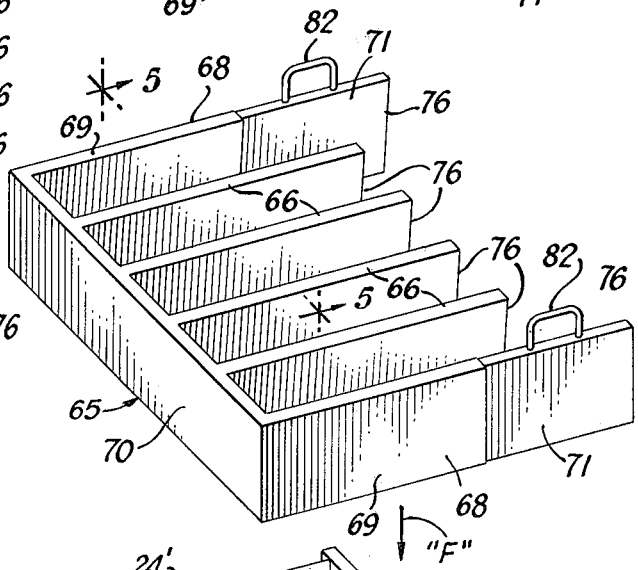
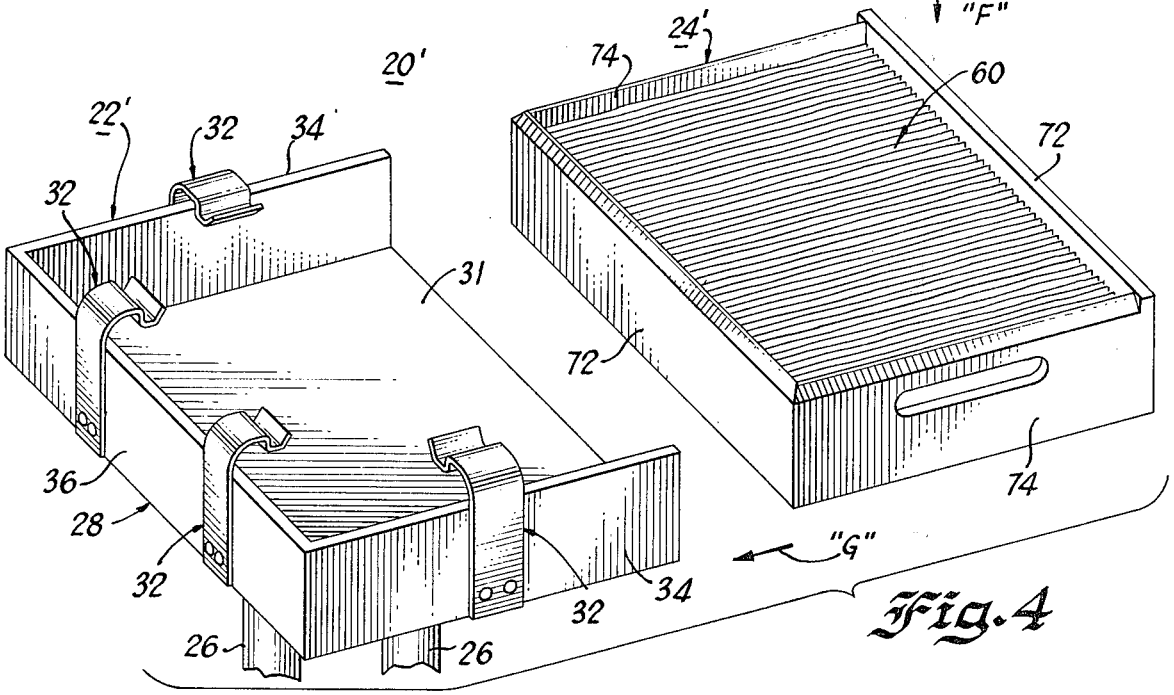
Fig. 4

PROCESS AND APPARATUS FOR ALIGNING PAPER DOCUMENTS

BACKGROUND OF THE INVENTION

A. Field of the Invention

This invention relates generally to processes and apparatus for aligning paper documents and, more particularly, to paper joggers and processes suitable for aligning the edges of retail store coupons or the like.

B. Description of the Prior Art

In the past, paper documents, such as checks, airline tickets, utility bills, credit card receipts and retail coupons, have been aligned preparatory to being scanned at very high speeds by automated equipment. It is desirable to align such documents, which are often of irregular shapes and sizes, in order to facilitate their scanning and subsequent sorting. Illustrative examples of prior processes and apparatus for aligning paper documents are set forth in the following United States patents: Roessle U.S. Pat. No. 954,136; Wilson U.S. Pat. No. 1,236,892; Carlton U.S. Pat. No. 1,694,499; Weyandt U.S. Pat. No. 2,494,075; Wilson et al U.S. Pat. No. 3,223,410; Snellman et al U.S. Pat. No. 3,388,907; Fackler et al U.S. Pat. No. 3,627,312; Ruud U.S. Pat. No. 3,656,743; Ayer U.S. Pat. No. 3,931,880 and Herold et al U.S. Pat. No. 3,945,095.

Conventionally, paper joggers utilize a fixed tray for holding paper to be jogged. The tray is connected to a vibratory mechanism which imparts oscillatory motion in one or more directions to the paper documents to align the documents along at least two edges. For example, L-shaped trays generally mounted at an angle with respect to a horizontal plane have been used so that the paper documents to be jogged are contacted along the two edges to be aligned. In addition, such trays have included a plurality of dividers within each tray extending parallel to the paper documents to be jogged to divide the documents into discrete segments to facilitate the oscillation of the individual documents.

Conventional paper jogging processes include as a first step the loading of a transfer tray with a large number of paper documents to be jogged. Once loaded, the transfer tray is taken to a paper jogging machine where the documents are removed by hand from the transfer tray and placed on edge between dividers in a fixed paper jogging tray fixedly secured to a portion of the jogging machine. Usually the jogging machine is operating while the documents are being placed in the fixed tray. The documents are oscillated by the jogging machine until the edges of the documents are sufficiently aligned. While the jogging machine is still functioning, an operator may manually remove the aligned paper documents from the fixed tray and return the documents to the transfer tray while being careful to maintain the edges of the documents in alignment.

Such conventional processes are very labor intensive, difficult and unsatisfactory in requiring the repeated handling of the paper documents to be jogged, often resulting in the loss of the prearranged sequence and the alignment of the paper documents.

SUMMARY OF THE INVENTION

Accordingly, it is an object of the present invention to provide an improved paper jogging process and apparatus.

It is another object of the present invention to provide a paper jogging process and apparatus that enables faster paper jogging while eliminating many of the manual steps required in the past, including the manual transfer of paper documents to be jogged from one tray to another and then back to the original or another tray.

It is another object of the present invention to provide a process and apparatus for jogging paper documents that prevents properly sequenced documents from becoming disordered during placement in or removal of the documents from a jogging machine.

It is still another object of the present invention to provide a process and apparatus for jogging paper documents that does not require repeated loadings and unloadings of several trays to align the edges of the documents.

In accordance with a preferred embodiment of the present invention, a process and an apparatus for aligning the edges of paper documents includes a paper jogger that eliminates one or more manual steps conventionally required in prior paper jogging processes and apparatus. The paper jogger includes a vibratory mechanism having a vibrated support for releasably receiving a paper tray containing the paper documents to be jogged. A divider is also removably positioned in the tray to divide the paper documents in the tray into separate or discrete portions.

BRIEF DESCRIPTION OF THE DRAWING

The above and other objects and advantages and novel features of the present invention will become apparent from the following detailed description of the preferred embodiment of the present invention illustrated in the accompanying drawing wherein:

FIG. 4 is a partial, exploded perspective view of an alternate embodiment of the portion of a paper jogger depicted in FIG. 1 constructed in accordance with the principles of the present invention;

FIG. 5 is a cross sectional view of a portion of the device of FIG. 4 taken along line 5—5 of FIG. 4;

FIG. 6 is a cross sectional view of a portion of the device of FIG. 4 taken along line 6—6 of FIG. 4; and FIG. 7 is a top plan view of the device depicted in FIG. 4 in an assembled condition.

DETAILED DESCRIPTION OF THE PREFERRED EMBODIMENT

Figure 1:
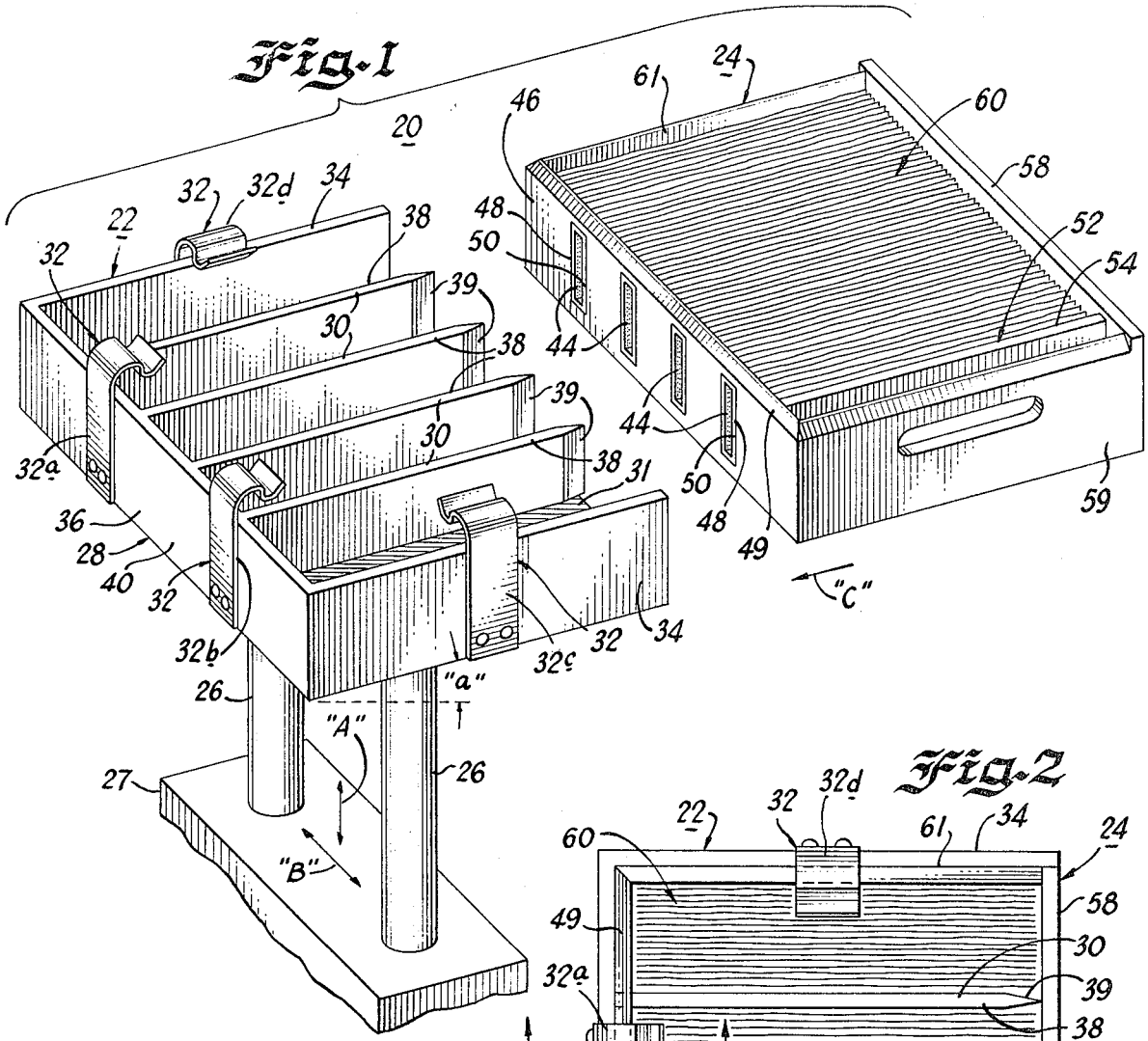
FIG. 1 is a partial, exploded perspective view of a portion of a paper jogger constructed in accordance with the principles of the present invention.

Referring to the drawing wherein like reference characters are used for like parts throughout, a jogging machine 20 is illustrated in FIG. 1, having a jogging platform 22 and a paper tray 24. The jogging platform 22 is connected by a plurality of vertical posts 26 to a conventional fluidic or electromechanical vibratory mechanism 27, illustrative examples of which are set forth in the aforementioned U.S. Pat. Nos. 1,236,892; 1,694,499; and 3,223,410.

The jogging platform 22 includes a U-shaped outer frame 28, a plurality of parallel divider splines 30, a transverse base 31, and a plurality of spring clips 32 mounted on the outer frame 28. If desired, the plane of the base 31 of the jogging platform 22 may be oriented at an angle "a" of, for example, approximately 45° with respect to a horizontal plane, as is well known in the art. The oscillations or vibrations imparted to the jogging platform 22 by the mechanism 27 may include a vertical component indicated by an arrow "A" (FIG. 1) or a horizontal component indicated by an arrow "B", or a combination of both horizontal and vertical components, as is also well known in the art.

The outer frame 28 includes a pair of opposed support members 34 connected to and separated by a cross-beam 36. The base 31 is attached to the lower side of the frame 28. A plurality of splines 30 extend outwardly from the cross-beam 36 parallel to and between the support members 34 and spaced slightly above the top of the base 31. Preferably the unattached end 38 of each divider spline 30 has a tapered edge 39 extending transversely to the length of the spline 30.

Figure 3:
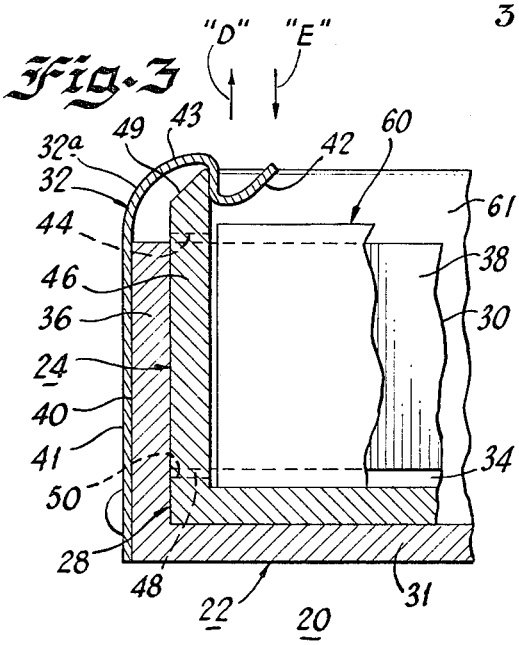
FIG. 3 is an enlarged, fragmentary, cross sectional view of the device depicted in FIG. 2 taken along line 3—3 of FIG. 2.

Each of the support members 34 and of the cross-beam 36 has at least one generally S-shaped spring clip 32 which is suitably attached, such as by a threaded fastener, to the outer side 40 of the frame 28. The spring clips 32, as shown in FIG. 3, include a vertical attachment portion 41, an arched portion 43 extending inwardly over the platform 22 and an upturned end 42. The clips 32 are preferably made of resilient material having elastic memory such as spring steel.

The paper tray 24 is in the form of a rectangular box having an open top, a base (not shown), a pair of longitudinal sides 46 and 58, and a pair of lateral sides 59 and 61. The longitudinal side 46 includes a plurality of slots 44 appropriately spaced along its length. The slots 44 are sized to receive the splines 30 of the platform through the side 46 and across paper tray 24, parallel to the sides 59 and 61, until the ends 38 of the splines 30 are adjacent the longitudinal side 58. Preferably, each slot 44 has a gasket 48 disposed about its inner periphery 50 to insure a tight fit between the outer surfaces of the splines 30 and the interiors of the slots 44.

The tray 24 (FIG. 1) also includes a compression adjuster 52 having a cross-member 54 that extends across the tray 24 from the side 46 to the side 58 and a coiled spring 56 positioned transversely to the cross member 54 and retained between the cross-member 54 and the side 59 of the tray 24. The spring 56 biases the cross-member 54 away from the side 59 of the tray 24 to permit a plurality of paper documents 60 disposed in the tray 24 parallel to the cross member 54 to be compacted together. When the tray 24 is fully loaded with paper documents, the cross-member 54 will be positioned between the slot 44 nearest the side 59 and the side 59.

Figure 2:
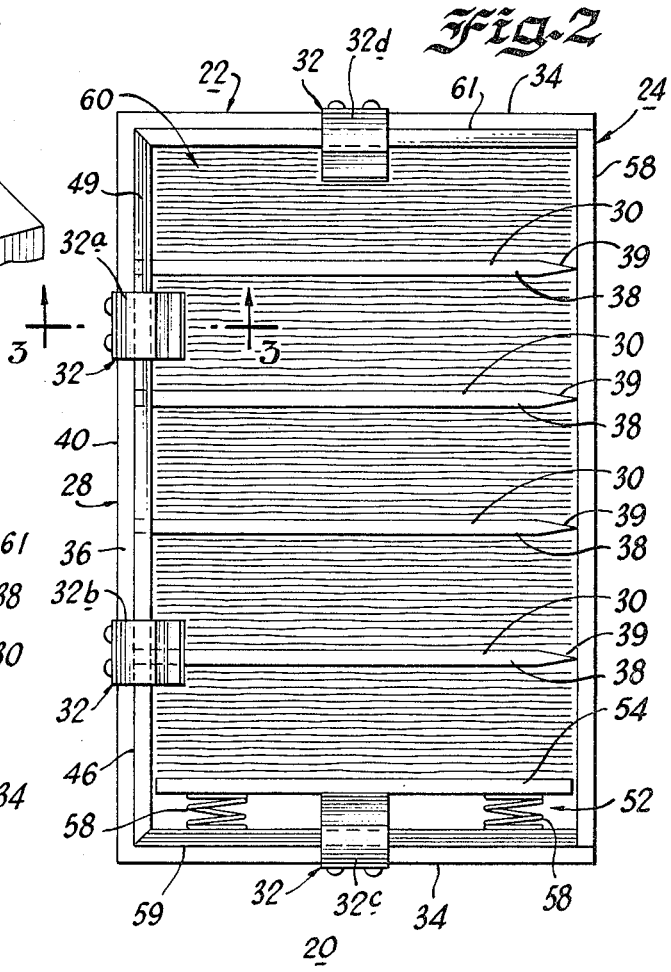
FIG. 2 is a top plan view of the device depicted in FIG. 1 in an assembled condition.

The tray 24 is moved onto the jogging platform 22 as indicated by the arrow "C" (FIG. 1), resulting in a combined arrangement thereof (FIG. 2). More specifically, as splines 30 are received in the tray 24 through the slots 44, the transverse base 31 moves relative to the lower surface of tray 24. The tray 24 is guided onto platform 22 by the opposed members 34 of the platform 22 which guide the opposed lateral sides 59 and 61 of the tray 24 toward the cross-beam 36. When the tray 24 is flush against the U-shaped outer frame 28, it may be securely held on the jogging platform 22 by the spring clips 32 which attach to the sides 46, 59 and 61 of the tray 24. The spring clips **32*a* and 32*b* on the crossbeam 36 are biased upwardly by the intervention of the side 46 of tray 24 on platform 22 as the side 46 approaches the cross-beam 36. More particularly, the upturned ends 42 and the clips 32*a* and 32*b* are first contacted by the beveled upper edge 49 of the side 46. As the edge 49 of the side 46 pushes against each spring clip 32, the upturned end 42 is cammed upwardly in the direction of the arrow "D" (FIG. 1). After the side 46 passes the upturned end 42 under the arched portion 43, the spring clips 32*a* and 32*b* spring downwardly in the direction of the arrow "E" (FIG. 3). The side 46 (FIG. 3) is clamped to the cross-beam 36 between the attachment portion 41 and the upturned end 42. Th spring clips 32*c* and 32*d* located on members 34 operate in the same manner to clamp the sides 59 and 61 to the members 34**.

The passage of the splines 30 between the sheets of paper 60 in the tray 24 is facilitated by the tapered edges 39. Conveniently, the tapered edges 39 are also tapered transversely to the edges 39 to form a pointed leading edge (not shown) of a very small cross sectional area to further facilitate the insertion of the splines 30 between the paper documents 60.

Thus, the tray 24 may be loaded with paper documents 60 to be aligned prior to approaching the jogging machine 20. When the paper documents 60 are ready for alignment, the tray 24 containing the paper documents 60 is simply positioned on the jogging platform 24; and the jogging machine 20 is turned on, if it is not already operating. Once the paper documents 60 are sufficiently aligned, the tray 24 may then be removed from the jogging platform 22 and taken to another location, if desired, for storage or subsequent processing of the paper documents 60.

In an alternate embodiment (FIGS. 4–7), the jogging machine 20' includes a jogging platform 22', a paper tray 24', and a divider 65. The divider 65 is a unitary structure, separable from the rest of the apparatus, having a plurality of intermediate splines 66 and a pair of opposed reciprocal splines 68, to either side of the splines 66, all connected by a cross-member 70. Each spline includes a pair of telescoping portions 69 and 71 biased against compression by an internal spring 73 (FIG. 6). The tray 24' is identical to the tray 24 except for the absence of the slots 44 and the compression adjuster 52. The platform 22' having a U-shaped frame 28, a base 31 and spring clips 32 is identical to the platform 22 except for the absence of the attached splines 30 on the platform 22'.

The divider 65 fits into the tray 24' through its open upper side by first compressing the reciprocal splines 68 upon themselves until the length of the splines 68 is equal to the distance between the opposed interior sides 72 of tray 24'. Each spline 68 will then lie flush against one of the opposed interior lateral sides 74 of the tray 24'; and each spline 66 or 68 will have its end 76 flush against one of the interior sides 72 of the tray 24'. In the case of the splines 68, the ends 76 will be spring biased against a side 72. The divider 65, preferably made of sheet metal, may be positioned in the tray 24' when the tray contains a plurality of documents or sheets of paper 60 by pressing the divider 65 into the paper laden tray 24' in the direction of the arrow "F" (FIG. 4). The tapered bottom edges 80 of the splines 66 and 68 (FIGS. 4 and 5) extend parallel to the exposed edges of the paper 60 to permit the splines 66 to slip easily between the sheets of paper 60 in the tray 24' and to permit the splines 68 to slip easily between sides 74 and the adjacent paper 60. Similarly, the bottom edge of cross-member 70 may be tapered to facilitate its insertion between the paper 60 and a side 72. The tray 24' with the divider 65 in place is then slid onto the platform 22' in the direction of arrow "G" (FIG. 4). The platform 22', the tray 24' and the divider 65 are all clamped together (FIG. 7)

by the spring clips 32 as described with respect to the embodiment shown in FIG. 3.

In operation, the paper documents 60 to be jogged are first loaded into the tray 24'. The divider 65, conveniently grasped by the handles 82, is inserted into the tray 24' in the direction of the arrow "F" (FIG. 4); and the assembled divider 65 and the tray 24' are moved onto the platform 22' and vibrated or oscillated to align the paper documents 60. After sufficient alignment of the paper documents 60, the tray 24' and the divider 65 are removed from the platform 22'; and the divider 65 may be removed from the tray 24'. The tray 24' containing the paper documents 60 may then be taken to any desired location for subsequent storage or processing of the paper documents 60.

While particular embodiments of the paper jogging machine 20 according to the invention have been described, it should be understood that many modifications and variations of the present invention are possible in light of the above disclosure. For example, instead of using a divider with connected splines, a plurality of unconnected splines may be used which are held within the tray in grooves formed therein or in any other suitable manner. The individual splines may be positioned in the tray as the tray is filled with documents. Thus, since many modifications and variations of the present invention are possible in light of the above teachings, it is to be understood that, within the scope of the appended claims, the invention may be practiced otherwise than as specifically described above.

What is claimed and desired to be secured by Letters Patent of the United States is:

1. A paper jogger comprising:

a vibratory mechanism;

a vibratory support connected to said vibratory mechanism;

a paper tray for holding a plurality of paper documents to be jogged, said tray being releaseably securable to said vibratory support; and dividing means removably receivable within said tray for dividing said paper documents into discrete portions, said dividing means including a plurality of splines extending outwardly of said vibratory support, said tray including a plurality of elongated slots formed therein through which said splines are received in said tray.

2. A paper jogger as defined in claim 1 wherein said splines include tapered edges to facilitate the receipt of said splines in said tray and the division of said paper documents into said discrete portions.

3. A paper jogger as defined in claim 1 wherein said tray is slidable onto said support, said jogger including means for releaseably securing said tray on said support and for facilitating the engagement and disengagement of said tray with said support.

4. A paper jogger as defined in claim 3 wherein said releaseably securing means comprises a spring biased clip.

5. A paper jogger as defined in claim 4 wherein said spring biased clip comprises a generally S-shaped strip of resilient material having an elastic memory.

6. A paper jogger comprising:

a vibratory mechanism;

a vibratory support connected to said vibratory mechanism;

a paper tray for holding a plurality of paper documents to be jogged, said tray including a bottom and two pairs of opposed sides, said tray and said support adapted for sliding engagement and disengagement therebetween; and means for releaseably securing said tray to said support;

said support having means for dividing said tray into compartments, said dividing means having a plurality of splines extending outwardly of said support, said splines being adapted to slide into and out of said tray generally parallel to two sides of said tray to divide said tray into compartments.

7. A paper jogger as defined in claim 6 wherein one of said sides of said tray has a plurality of openings to receive said splines and wherein said support includes a base extending outwardly thereof generally parallel to said splines for supporting said tray.

8. A process for jogging paper documents comprising the steps of:

loading a tray with paper documents to be aligned by jogging;

separating said paper documents within said tray into discrete portions by removably positioning a plurality of dividers in said tray;

releaseably securing said tray to a motive source of vibratory motion by simultaneously sliding said tray onto said motive power source while positioning said dividers in said tray;

operating said motive source to align said paper documents within said tray;

removing said tray from said motive source; and removing said dividers from said tray.

9. A paper jogger comprising:

a vibratory mechanism;

a vibratory support connected to said vibratory mechanism;

a paper tray for holding a plurality of paper documents to be jogged, said tray being releaseably securable to said vibratory support; and dividing means removably receivable within said tray for dividing said paper documents into discrete portions, said dividing being physically distinct and separable from said vibratory mechanism, said vibratory support and said paper tray, said dividing means comprising a unitary structure including a plurality of arms and a cross-beam, said arms extending from said cross-beam, said dividing means being adapted to slide into said tray.

10. A paper jogger as defined in claim 9 wherein said dividing means includes a pair of reciprocal arms extending from said cross-beam, said arms being biased against the inside of said tray.

11. A paper jogger as defined in claim 9 wherein the lower edges of said arms are tapered to facilitate their insertion between stacked documents to be jogged.

* * * * *